US007641058B2

(12) United States Patent
Silverman

(10) Patent No.: US 7,641,058 B2
(45) Date of Patent: Jan. 5, 2010

(54) AIRBRUSH HANGING WORK STATION AND BRACKETS

(76) Inventor: Clifford Jory Silverman, 1460 Guerin Road, Green Oaks, IL (US) 60048

( * ) Notice: Subject to any disclaimer, the term of this patent is extended or adjusted under 35 U.S.C. 154(b) by 90 days.

(21) Appl. No.: 11/983,031

(22) Filed: Nov. 6, 2007

(65) Prior Publication Data

US 2008/0128564 A1 Jun. 5, 2008

Related U.S. Application Data

(60) Provisional application No. 60/856,988, filed on Nov. 6, 2006.

(51) Int. Cl.
*A47B 81/02* (2006.01)

(52) U.S. Cl. ..... 211/66

(58) Field of Classification Search ..... 211/65, 211/66, 70.6, 87.01, DIG. 1, 106.01, 86.01; 248/683, 467, 206.3, 206.4, 309.3
See application file for complete search history.

(56) References Cited

U.S. PATENT DOCUMENTS

D65,357 S * 7/1924 Strnad ..... D6/528
2,472,058 A * 6/1949 Artley ..... 211/13.1
D171,468 S * 2/1954 Simon ..... D6/528
4,446,972 A * 5/1984 Sussman ..... 211/26
5,507,414 A * 4/1996 Ong ..... 222/108
5,566,842 A * 10/1996 Dennis ..... 211/87.01
5,740,927 A * 4/1998 Yemini ..... 211/70.6
5,755,338 A * 5/1998 vom Braucke et al. ..... 211/13.1
6,318,569 B1 * 11/2001 Rothing ..... 211/90.01
6,811,619 B2 * 11/2004 Hayakawa et al. ..... 148/111
2003/0089673 A1 * 5/2003 Herren ..... 211/66
2005/0167379 A1 * 8/2005 Hoy ..... 211/66
2005/0279663 A1 * 12/2005 Citrigno ..... 206/362.1

* cited by examiner

*Primary Examiner*—Jennifer E. Novosad
(74) *Attorney, Agent, or Firm*—Justin Lampel

(57) ABSTRACT

An airbrush hanging work station and brackets that will hang a multiple number of airbrushes and related airbrushing components, materials and art supplies. This device hangs to a wall or bench by a variety of methods such as magnetically, bolt on, or with a bench clamp. It has a plurality of airbrush hanging attachments that attach to its side walls and front walls, or these airbrush hanging attachments can be individually mounted to a wall or surface and used individually. These airbrush hanger brackets will hang most airbrushes regardless of the varying shapes, sizes and dimensions of different airbrushes due to the unique adjusting components and shape of the airbrush hangers' design.

1 Claim, 8 Drawing Sheets

AIRBRUSH HANGING WORK STATION AND BRACKETS

CROSS-REFERENCE TO RELATED APPLICATIONS

This application claims the benefit of provisional patent application Ser. No. 60/856,988, filed Nov. 6, 2006 by the present inventor.

FEDERALLY SPONSORED RESEARCH

None.

SEQUENCE LISTING

None.

BACKGROUND OF THE INVENTION

1. Field of Invention

This invention relates to an airbrush hanging work station with multiple attached airbrush hanging brackets that will hang a plurality of airbrushes and related materials and art supplies. This airbrush hanging work station and brackets hangs to a wall or bench by a variety of methods such as magnetically, bolt on, or with a bench clamp. Its unique ability to hang various types of airbrushes is due to the adjustable components on the airbrush hanger brackets and the overall bracket design. Its ability to hang other items such as airbrush supplies is unique in the fact that the applicable airbrush tools and materials can be stored together on this unique apparatus.

2. Prior Art

The inventor has recognized, in the Airbrushing and Automotive Custom Painting Industry, that a specific need exists for a work station to allow an artist to keep multiple airbrushes and all the related paints and supplies close at hand while doing artwork. This work station would need to hold all types of airbrushes since it would be too costly and inconvenient to have various hangers for each type of airbrush on the market. Most airbrush artists use many different types of airbrushes and these airbrushes do vary in size and shape. The hanger would need to be universal to hold just about every type and style of airbrush. The inventor found that the best way to accomplish this would be to provide adjustable hanging components and special notches and swiveling features on the components that do the 'hanging' of the airbrush.

This work station would need to mount to a wall surface very easily and be removable from the wall with speed and ease because an airbrush artist often works in different places and would need to take the hanging device with to where the work is. Since many walls are metal, a work station with magnetic mounting ability would serve most artists. The work station would also have the ability to be permanently bolted to a surface if the user so chose. In other optional embodiments, the device could have a bench clamp to clamping to a side of a table or counter etc.

Common related objects that are used while painting are also able to hang on this device such as tape, air hoses, tack cloth, exacto knife, pencils and other items. These objects have a place to be stored within the device on specifically designed components and storage partitions.

Other prior art and designs of storage devices exist for storing other items, although no prior art has been found that is specifically intended for airbrushes. Some prior art that has been found does show some similarities in the ways it can hang items, but none is similar in scope and overall design such as the airbrush hanging work station and brackets cited by my invention.

U.S. Pat. No. 5,505,351 to Najarian (1996) discloses a hanger for a pre-tied knotted necktie assembly in which the assembly includes a necktie, a knot support to form a necktie knot, a clip for mounting, and removing, the necktie assembly onto the neckband of a shirt collar, and a positioning post extending through the necktie knot. Although this disclosure shows an easily removable mounting method, it lacks the details and variations of hanging multiple sizes and types of items within its own system. Its slotted hanging area can be shown similar to the slotted hole in the airbrush hanging assemble, but Najarian does not offer adjustability in this design.

U.S. Pat. No. 7,249,699 to Hill (2007) discloses a collapsible garment hanger with quick-release lever in which is understood as an apparel apparatus that hangs narrow or small necked shirts and sweaters. It is a collapsible hanger that also has moving parts. There are two hanger arms that rotate about pins on a hanger body, and there is a fulcrum about which a quick-release lever and release tabs pivot so that a locking mechanism can be manipulated. These features can be compared to the airbrush hanging work station and brackets due to the fact that the levers, or hangers, can be released and moved, but the overall design differs greatly from mine since it only hangs one garment at a time, not 3 or more, and it is hooked to a surface without magnets. It also differs in the way its adjustable sizing for different garments. It has locking position that adjust for various sizes but they lock in pre set holes, not a sliding slot for fine tuning of adjustment.

U.S. Pat. No. 7,016,199 to Burgers (2006) discloses a receiver with sliding hanger structure designed to receive and engage an interchangeable test adapter such that electrical contacts carried by the interchangeable test adapter and receiver have the capability to release and engaged. The receiver includes sliding cam plates driven by a lever assembly and adjacent sliding hanger structures that are retractable. This is similar in a slight way to the airbrush hanging assembly in the way it slides and retracts, although it will not perform similarly in the way it is adjusted partially open or closed positions to hold shape. The scope of this invention differs entirely, but thought it should be noted due to its retractable feature.

U.S. Pat. No. 6,983,506 to Brown (2006) discloses a universal, interchangeable tool attachment system offering various tool operator heads and removable, or interchangeable handles, removable/replaceable tools and tool bits, hex drive, and clamp for securing tools, along with other related tools attached. This design shows a slight similarity in the way that multiple tools or working items can be arranged on one portable device, but it does not show similarities regarding adjustable positioning and easy removable action of the items once set in with the device. Although this device will allow the user to store the tools intended, and the user could adjust the position of the specific tool, the overall adjustment and storage design differs in broad scope.

U.S. Pat. No. 4,169,529 to Hunter (1979) discloses an item transport apparatus comprising a variable thickness carrier device that transports and processes a variety of items or articles including mail pieces of the letter or flat variety. The processing of such items may entail the sorting, compact storing and retrieving thereof. Although this device can move items along a slide, it is different in the way the slide works in comparison to the airbrush hanger work station and brackets. Hunter's disclosure keeps the intended items moving along the slide, whereby my invention is intended to hang the item stationary while the slide acts as an adjustment, not a transportation means.

U.S. Pat. No. 4,149,693 to LoNigro (1979) discloses a fixture support with twisted central portion used for installation in an openwork or grid-type suspension ceiling to support a fixture-hanging junction box. The invention comprises a one-piece strap-iron supporting bar which is adapted to bridge the space between a pair of conventional inverted T-irons. The respective outer end portions of the bar include right angularly positioned downwardly opening hooks which are hooked over the respectively cooperable T-irons and are held in place by accessible setscrews. The median portion of the bar is twisted to stand edgewise and serves to adjustably mount a hanger clip which is carried by the junction box. This description, directly from the patent abstract, describes the invention in the way the adjustability can be compared to the airbrush hanging work station and brackets. Although this invention shows an adjustable slide, or track type movement, it differs in the scope of what it is moving and how it works. This shows a single hanger sliding across a track to hang the items whereby my invention takes two hangers to slide toward or away from each other to hang the intended item, and the item is not attached to the hangers, it simply rests upon it. Permanent mounting of this device is required whereby my invention is capable of portability.

Although these inventions cited do show some similarities in the various slide adjustments, hanging brackets and other features, they all differ greatly in scope and none possess the full list of details as the airbrush hanging work station and brackets.

REFERENCE LIST OF PRIOR ART CITED

U.S. Pat. No. 5,505,351 to Najarian (1996)
U.S. Pat. No. 7,249,699 to Hill (2007)
U.S. Pat. No. 7,016,199 to Burgers (2006)
U.S. Pat. No. 6,983,506 to Brown (2006)
U.S. Pat. No. 4,169,529 to Hunter (1979)
U.S. Pat. No. 4,149,693 to LoNigro (1979)

OBJECTS AND ADVANTAGES

Accordingly, besides the objects and advantages of the airbrush hanging work station and brackets to hold multiple airbrushes and materials in my above patent, several objects and advantages of the present invention are:

(a) To provide a method of portability and easy placement of the work station by using mounting magnets for quick and easy attachment of the device to metal wall surfaces
(b) To hang a plurality of airbrushes from the device
(c) Has the ability to hang almost any type or style of airbrush regardless of the brand, size, style or shape due to airbrush hangers' adjustable components, the shape of the components, the specific slotting and cut-outs within the components, and the optional positioning of the hanging devices
(d) To hang tape, air hoses and other needed supplies on the specially equipped hooks
(e) To provide storage space for pencils, pens and cutting knifes on the dual purpose holding handle/storage flange
(f) To allow for the removal of the specially designed airbrush hanger assemblies and to use them individually by bolting or magnetizing them directly to a surface other than just the work station body
(g) To provide an area to store paint bottles and other liquids and materials for quick and easy access when soon to be in use when airbrushing

SUMMARY

This invention, the airbrush hanging work station and brackets, will hold a plurality of airbrushes, paint bottles, paint brushes, cutting knife, tape, razor blades and many other related art supplies while painting/airbrushing. This device keeps all of the needed items close at hand for the airbrush artist. The individual airbrush hangers are adjustable for the varying sizes and styles of airbrushes. The individual airbrush hangers can be used independently, apart from the airbrush hanging work station's main body if so desired.

More specifically, the following features are most unique of this airbrush hanging work station and brackets:

1. The airbrush hanging work station and brackets attaches magnetically to the wall for quick and easy placement while paint is drying, or for regular storage of the device. It can also be bolted or clamped to surfaces such as tables, walls or other substrates.
2. The individual airbrush hangers can be swiveled up and down to allow for the correct positioning for gravity to hold the airbrush in the needed position
3. The hanging brackets are adjustable for proper distancing to allow for varying sizes of airbrushes.
4. The tray holds a variety of items such as bottles, paint brushes, razor blades and more
5. The tape hangers hold various sizes of tape rolls, air hoses and other items

DRAWINGS

Figures

REFERENCE NUMERALS

1. Box body
1*a*. storage compartment vertical wall
1*b*. rear panel
1*c*. holding handle and pencil storage flange
1*d*. airbrush hanger attachment hole
1*e*. tape hook attachment hole
1*f*. mounting hole
2. Airbrush hanger assembly
2*a*. airbrush hanger bracket body
2*b*. airbrush resting holder
2*c*. slide slot
2*d*. slide section
2*e*. slide attachment hole
2*f*. rear vertical stabilizer
2*g*. airbrush holding port
2*h*. airbrush catching slot

2*i*. bolt
2*j*. wing nut
2*k*. washer
2*l*. distance washer
2*m*. box attachment hole
2*n*. horizontal slide riding section
3. Mounting Magnet
3*a*. rivet
4. Tape Hook Assembly
4*a*. shaft bolt
4*b*. covering
4*c*. cap nut

DETAILED DESCRIPTION OF THE PREFERRED EMBODIMENT: FIGS. 1, 2, 3, 4, 5, 6 and 7

Figure 1:
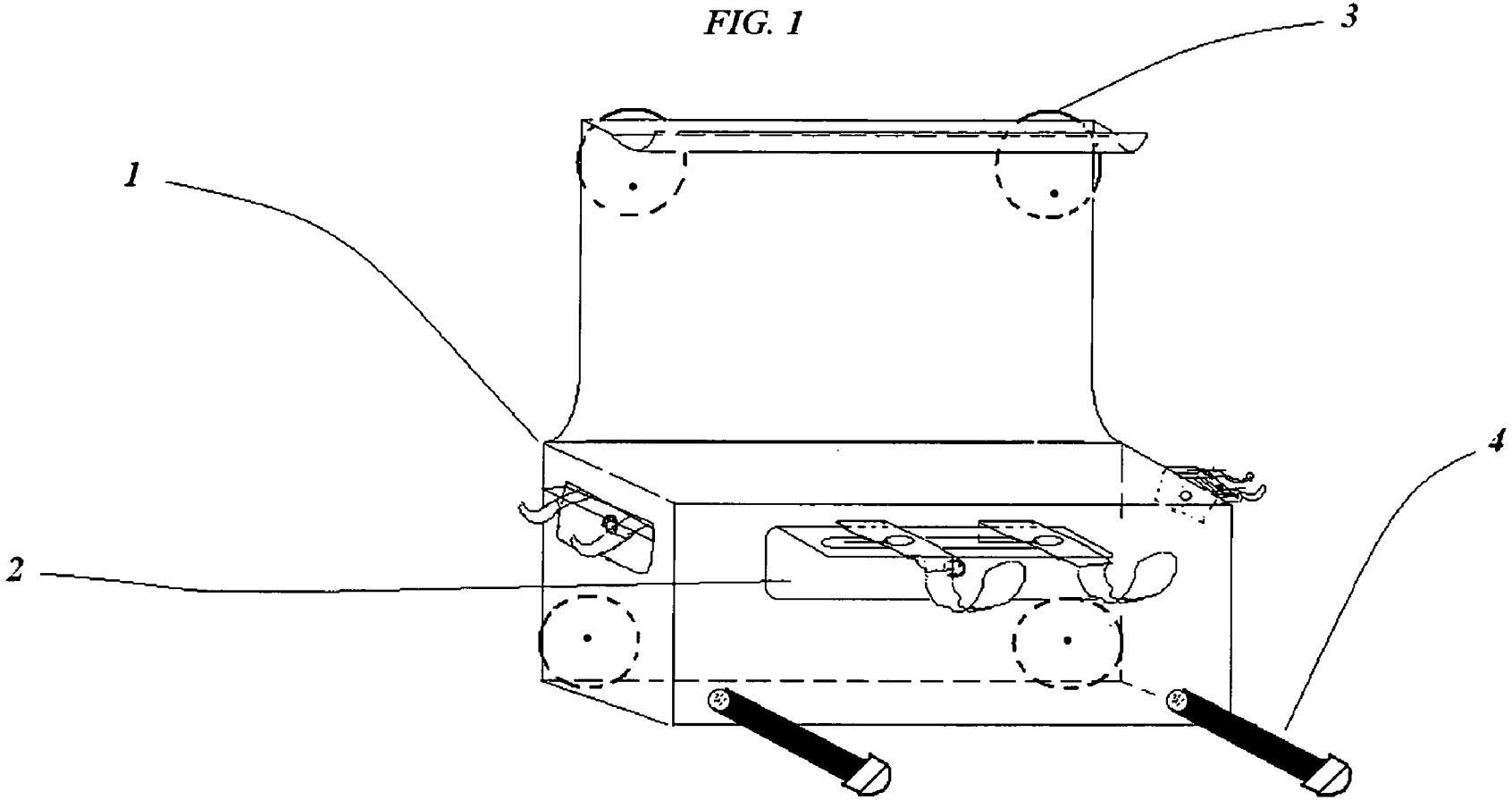
FIG. 1 shows the complete embodiment with the main components numbered

FIG. 1 shows an overall view of the device with its airbrush hanger assemblies 2, tape hangers 4, and transparent depiction of its mounting magnets 3 attached. The preferred material of construction is of 18 gauge sheet metal, although other materials could be used such as plastic, wood, fiberglass composites or other materials.

FIG. 1 depicts a magnetic attachment type that will attach to a metal surface by the direct contact of said mounting magnets 3 and said metal surface. An alternative form of mounting of the device can be to bolt directly to a wall surface by using the appropriate fasteners for the type of surface intended. In this instance, said mounting magnets 3 would not need to be attached to said box body 1. This optional form of mounting would be the preference of the user. Said mounting magnets 3 are attached to rear panel 1*b* at the mounting holes 1*f*. Attachment is made by a rivet 3*a*, as shown on FIG. 4, or said mounting magnet 3 can be bolted with the appropriate fasteners such as a nut and bolt.

Figure 2:
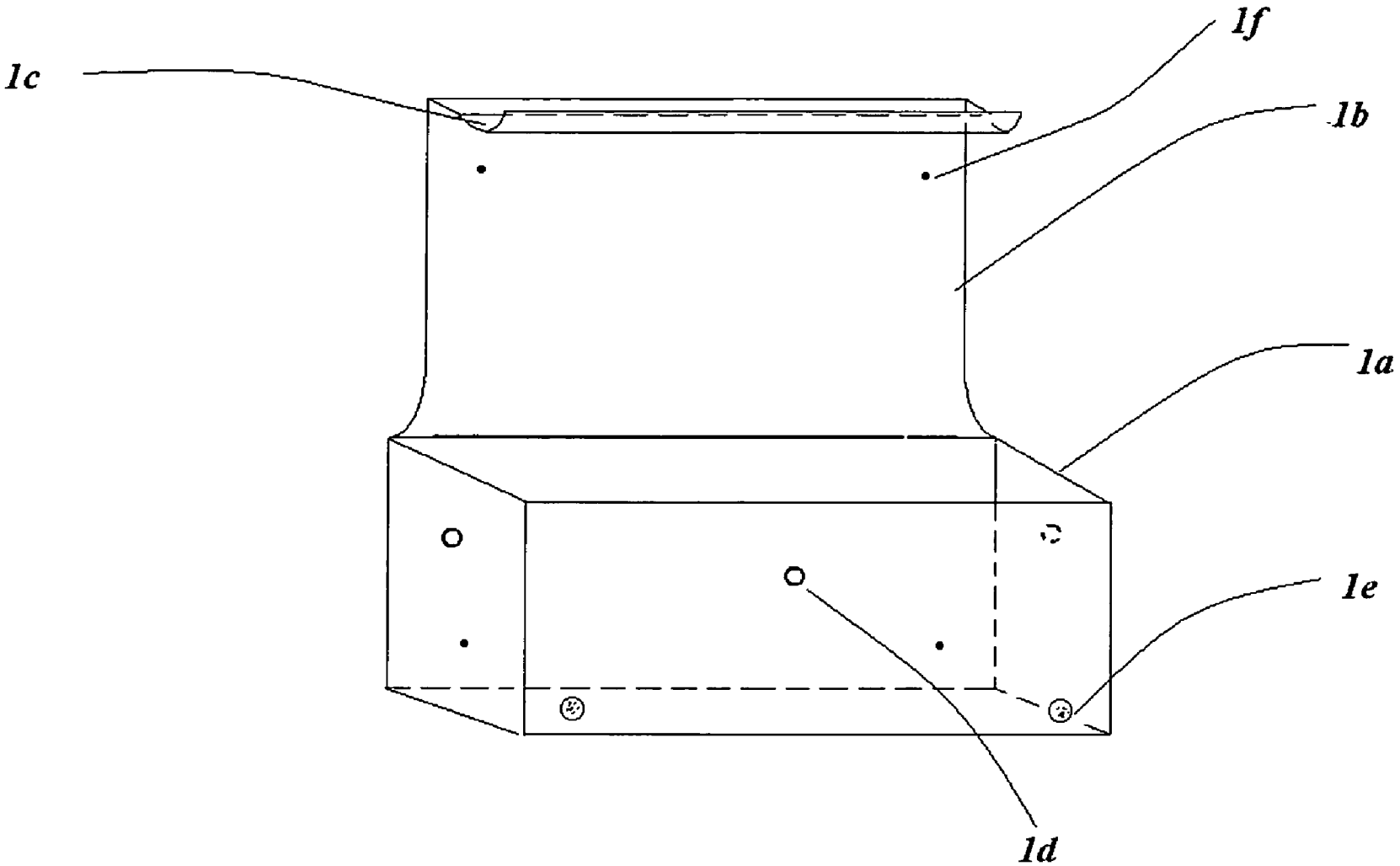
FIG. 2 shows the box body stripped of all components
Figure 5:
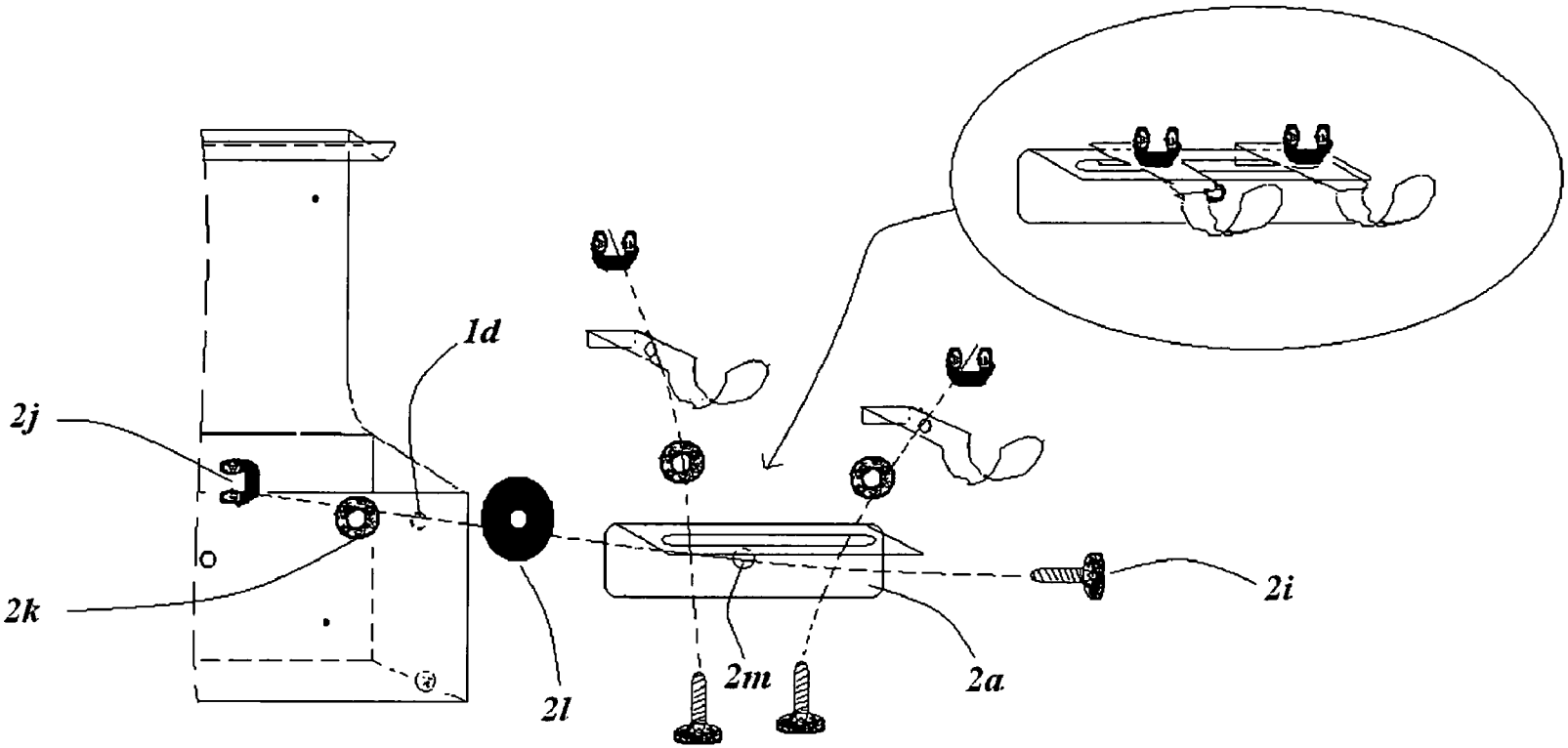
FIG. 5 shows way in which the airbrush hanger assemblies attach to the box body

Three of said airbrush hanger assemblies 2 are attached to said box body 1 on the sides and front storage compartment walls 1*a* as shown in FIG. 1. FIG. 2 shows the positioning of the airbrush hanger attachment holes 1*d* on said storage compartment walls 1*a*. Said airbrush hanger assemblies 2 mount to said storage compartment walls 1*a* with the appropriate components as shown on FIG. 5. FIG. 5 shows the detail of how said airbrush assembly 2 is attached. Bolt 2*i* is placed through box attachment hole 2*m* on the horizontal slide riding section 2*n*. A distance washer 2*l* is attached between said airbrush hanger bracket body 2*a* and said storage compartment wall 1*a* on said box body 1. Securing of the components is done with washer 2*k* and wing nut 2*j*. Prior to tightening, the proper swivel position is adjusted as shown on FIG. 7. Swivel positioning can be achieved at any angle from 0 degrees to 360 degrees from a level center line. Only a certain variation from the level and center line would be desired.

Figure 3:
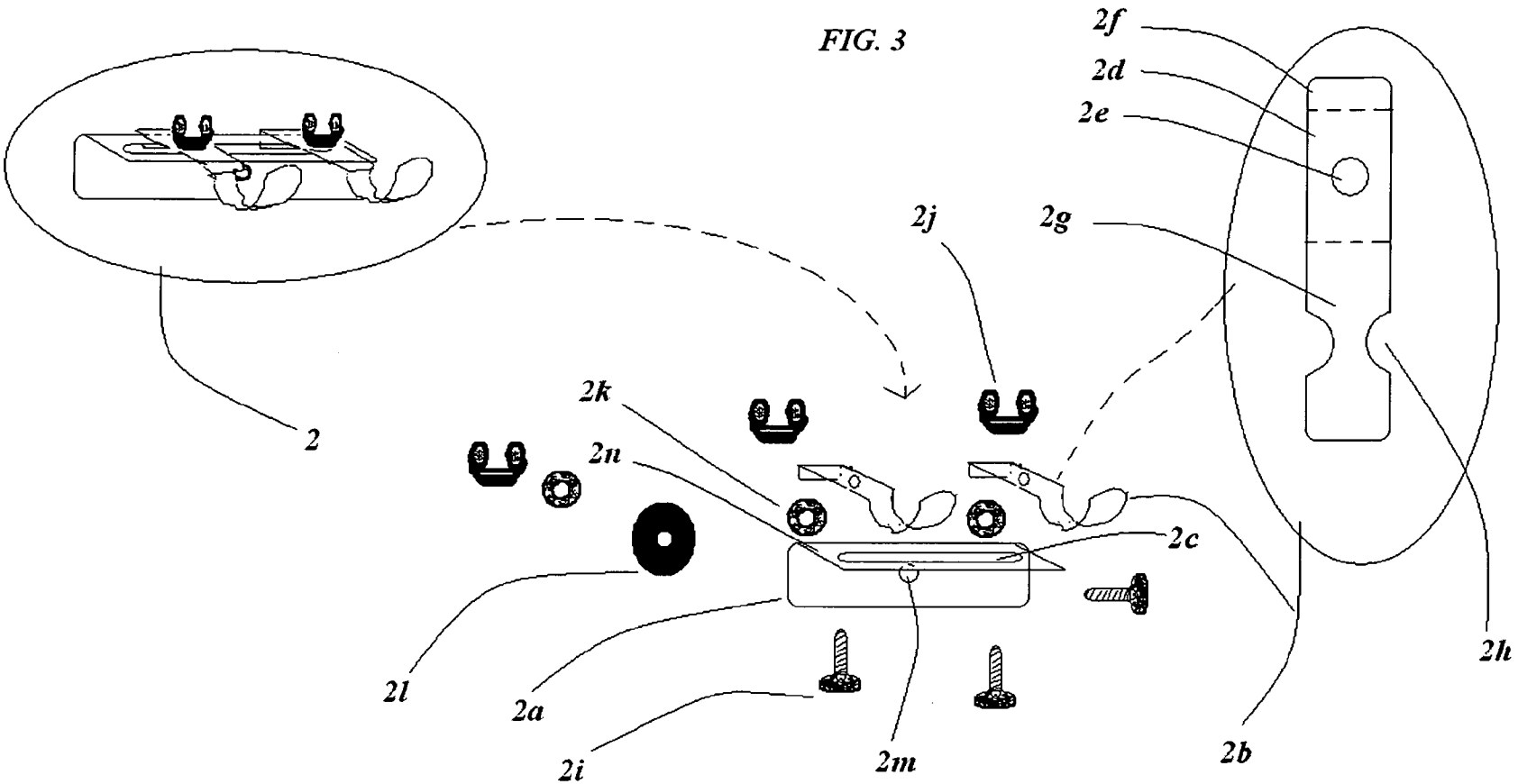
FIG. 3 shows the main airbrush hanger assembly components

Said airbrush hanger assemblies 2 consist of components and features that securely hang an airbrush. FIG. 3 shows the components and important sections in detail. Said airbrush hanger bracket body 2*a* attaches to sides of box body 1. Two of said airbrush resting holders 2*b* attach to airbrush hanger bracket body 2*a* with fasteners as shown in FIG. 5. Said airbrush resting holders 2*b* are connected with fasteners through the slide slot 2*c* along the top surface of said airbrush hanger bracket body 2*a*, on the horizontal slide riding section 2*n*. This allows the two airbrush resting holders 2*b* to slide toward and away from one another for various positioning to accommodate for the various sizes and shapes of different airbrushes.

Said airbrush resting holders 2*b* are shaped with a half circular cut-outs on each side of the rounded shaped holding ports 2*g*, as shown in FIG. 3. These cut-outs are the airbrush catching slots 2*h*. The airbrush sits at the bottom of said airbrush holding port 2*g*, and is held steady from falling side to side due to said airbrush catching slots 2*h*.

Figure 6:
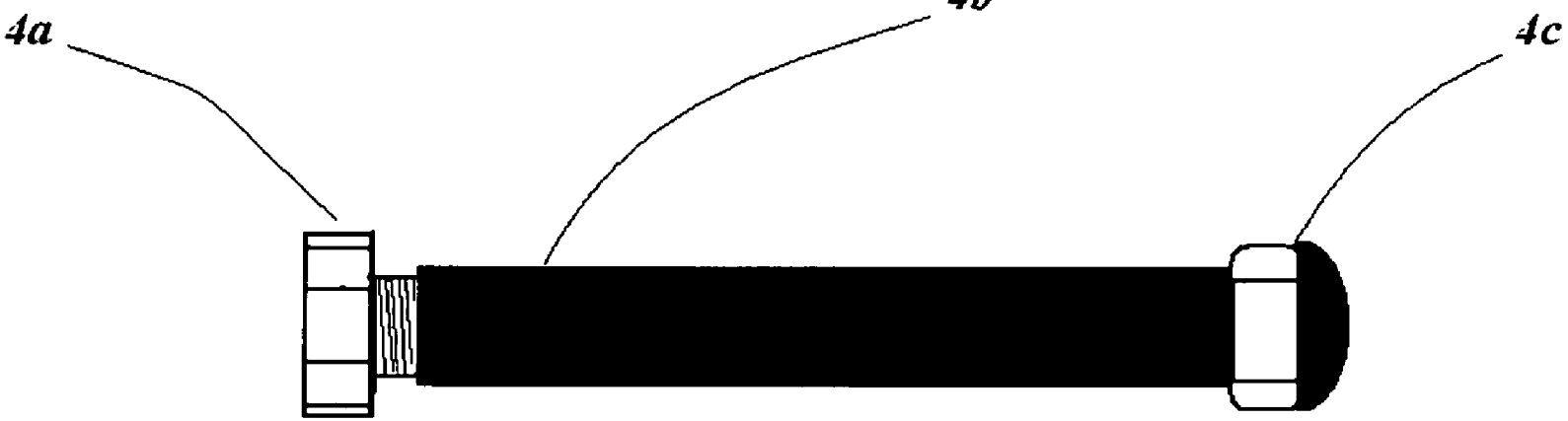
FIG. 6 shows the tape hook assembly

FIGS. 1 and 6 show said tape hook assembly 4 positioning and components. Tape hook assembly 4 is attached to said box body 1 at tape hook attachment hole 1*e*. Said tape hook assembly protrudes forward from said box body 1 out through said storage compartment wall 1*a* at two lower front sections. The main components that make us said tape hook assemblies 4 are the shaft bolt 4*a*, the covering 4*b* and cap nut 4*c*. Said shaft bolt 4*a* is placed through storage compartment wall 1*a* and secured into place by securing nut 4*d*. Said covering is slipped over said shaft bolt 4*a* and secured into place by said cap nut 4*c*. Tape hook assembly 4 is capable of hanging tape, air hoses and other items for storage when airbrushing.

Operation: FIGS. 1, 2, 3, 4, 5, 7 and 8

Said box body 1 is capable of holding multiple paint bottles and other painting materials within the confines of said storage compartment walls 1*a* and said rear panel 1*b*, shown in FIG. 1. The intended storage items are kept in these confines for quick and easy access while painting.

Box Body 1, as shown in my preferred embodiment in FIG. 2, is capable of holding up to three said airbrush hanger assemblies 2, although similar designs could be made to hold more.

Figure 7:
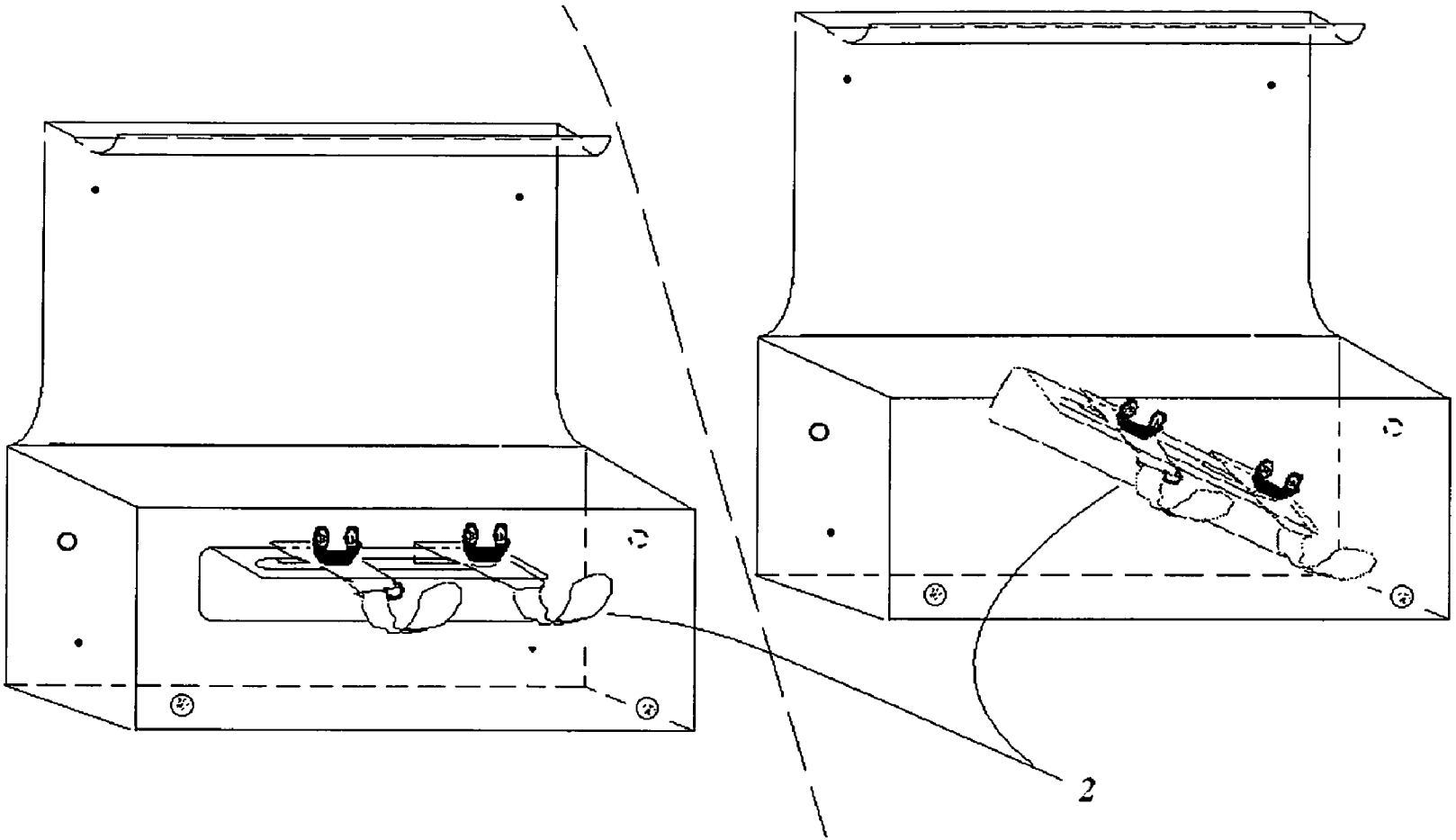
FIG. 7 shows the swivel capability of the airbrush hanger assembly when on the box body

Due to the varying sizes, styles and shapes of airbrushes, said airbrush hanger assemblies are capable of adjustment to accommodate for these variations. Said airbrush holding ports 2*g* is where the airbrush sits, and makes gravitational contact. Said airbrush catching slot 2*h* secures the airbrush into place by the trigger or air inlet on the airbrush, to rest in place within this slot. This will secure the airbrush from tipping on its side. Further security of holding the airbrush in place is derived by swiveling said airbrush hanger assembly 2 slightly downward or upward as needed due to said box attachment hole 2*m* and fastener wing nut 2*j*, as shown on FIG. 7. A space gap is created between said storage compartment wall 1*a* and the rear vertical stabilizer 2*f*. for easy swiveling of said airbrush hanger assembly 2. This gap is needed to allow said airbrush hanger assembly 2 to swivel up and down without interference or scraping of the components. The assembly that includes said distance washer 2*l* is shown on FIG. 5. If slight downward angling is needed to put gravitational force on the airbrush to keep in place on said airbrush catching slot 2*h*, then loosen said wing nut 2*j*, turn downward on said airbrush hanger bracket body 2*a* until the proper force is felt on the airbrush. Swivel positioning is achieved as shown in FIG. 7. Any degree of swivel can be made from level up to 360 degrees, although only slight swivel from center line is usually needed.

Due to the fact that different airbrushes vary in size, shape and where the components such as trigger, air inlet and handle are positioned on the airbrush, said airbrush resting holders 2*b* are movable side to side for repositioning. FIG. 3 shows a breakdown of said airbrush hanger assembly. Said airbrush resting holders 2*b* are placed upon said horizontal slide riding section 2*n*. Said slide attachment hole 2*e* of said airbrush resting holder 2*b* lines up with said the slide slot 2*c* along the center of the horizontal slide riding section 2*n* on said airbrush hanger bracket body 2*a* shown in FIG. 5. Bolt 2*i* fits up through said slide slot 2*c* and said slide attachment hold 2*e*. Bolt 2*i* is connected to wing nut 2*j* with washer 2*k* below. Said wing nut 2*j* is loosened to allow said airbrush resting holders 2*b* to slide left or right along said slide slot 2*c*. Once the desired position is achieved of said airbrush resting holders, said wing nuts 2*j* are secured into place. Proper positioning will vary with the different types and shapes of airbrushes. To further contain the airbrush in place, said airbrush catching slots 2*h* are grooves in the center bottom of said airbrush resting holders 2*b* intended to catch the airbrush's forward most part below the main body of the airbrush, such as the trigger or air inlet body. The slot shaped cut-out of said airbrush catching slot 2*h* will keep the airbrush from falling on its side due to gravity force and degree of swivel of said airbrush assembly 2.

Figure 4:
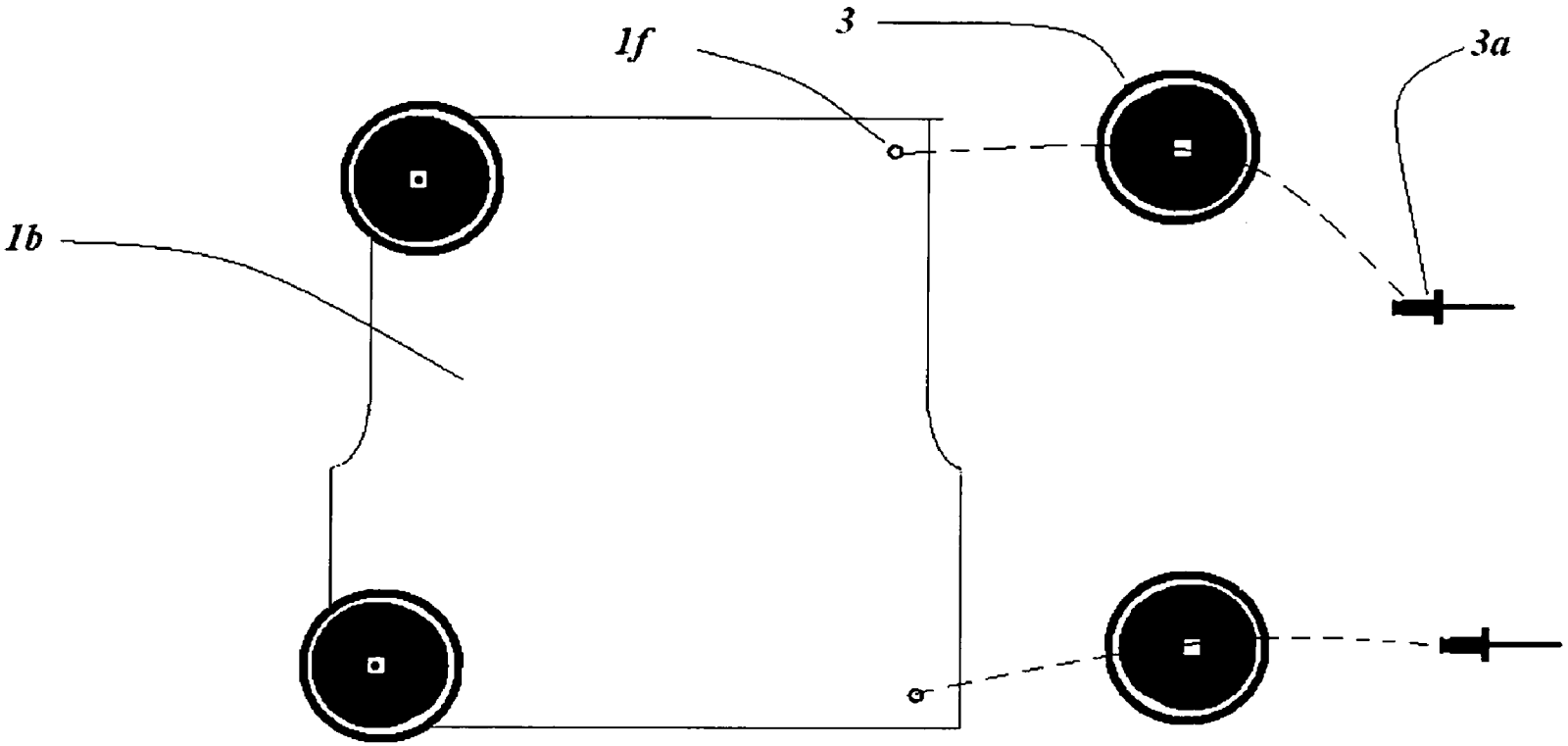
FIG. 4 shows the rear side of the box body with the mounting magnet attached

Said mounting magnets 3 are attached to said rear panel 1*b* through said mounting hole 1*f*. In most cases, a rivet 3*a* is used for the attachment of said mounting magnet to said rear panel 1*b* as shown in FIG. 4, although a nut and bolt could also be used. Said mounting magnets 3 suspend the device to a metal wall. In the event magnetic attachment is not needed or useable, then the device can be mounted to any wall surface directly with various types of fasteners or mounted in other ways.

Two tape hook assemblies 4 are shown in FIG. 1 as attached through said tape hook attachment hole 1*e*. Tape roll(s) and/or air hoses and various other materials can be suspended from said tape hook assemblies 4 for quick and easy storage.

The top part of said rear panel 1*b* folds over horizontally to form the holding handle and pencil storage flange 1*c*. This serves a dual purpose as a handle for carrying the entire device, and when not used for carrying, the half rounded shape of the flange serves as a pencil, pen or 'Exacto' knife storage area.

Figure 8:
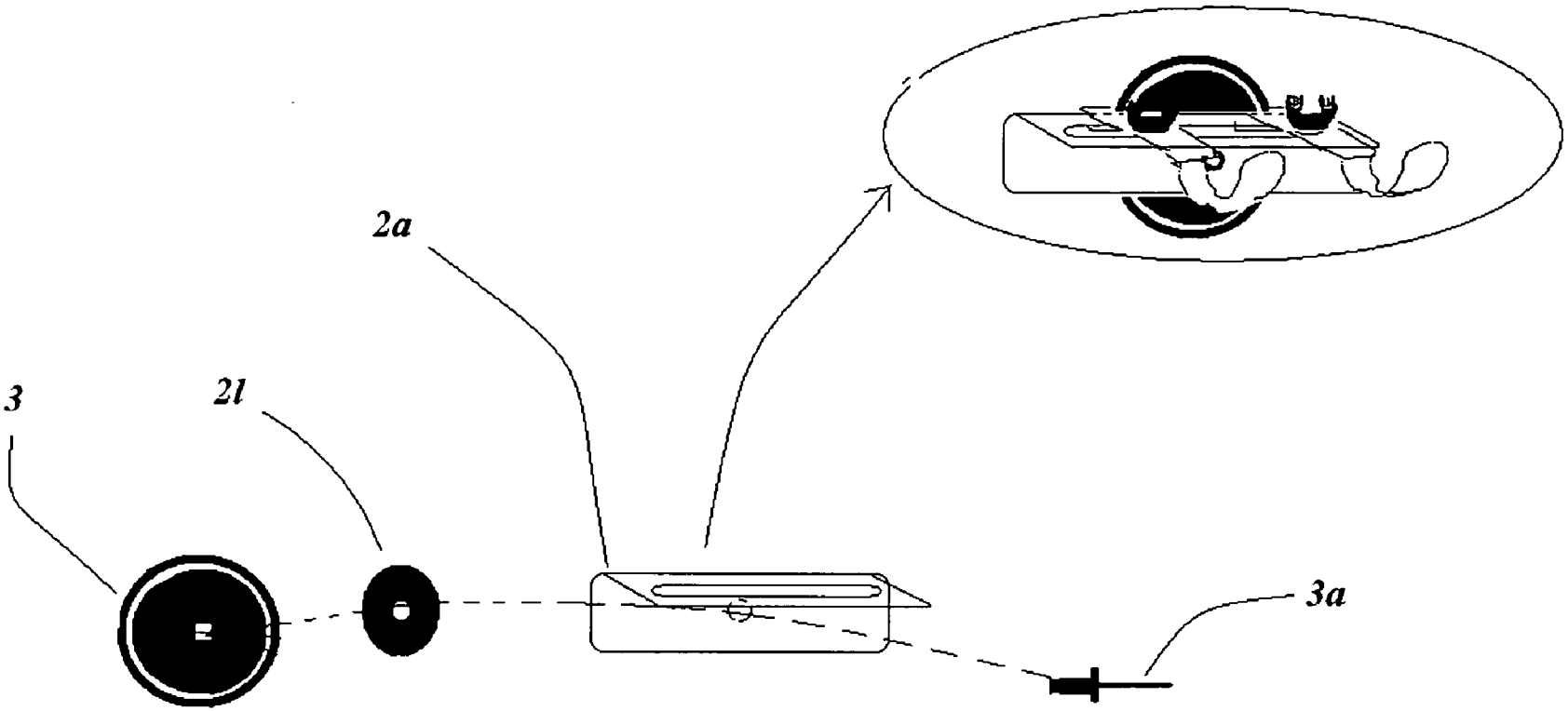
FIG. 8 shows the airbrush assembly with a magnet attached to be an independent item

Airbrush hanger assembly 2 can be fitted directly with said mounting magnet 3 by securing it with fasteners or said rivet 3*a* and attached directly to said storage compartment walls 1*a*, or it can be put directly on a metal surface and used individually, without said box body 1, as shown in FIG. 8.

CONCLUSION, RAMIFICATIONS, AND SCOPE

Accordingly, the reader will see that this airbrush hanging workstation and brackets of the type described will improve the ways in which an airbrush is stored, hung and secured in place. The overall organization of multiple airbrushes and the related paints, supplies and other components will be accessible and close at hand while doing airbrush artwork. The design, construction and overall functionality of this airbrush hanging workstation and brackets system will provide a system for the airbrush artist to:

- Hang multiple airbrushes at one general area
- Have a portable and movable work station by easily attaching it to a metal wall surface if so desired
- Ability to hang various types of airbrushes by adjusting the hanging components to slide open or closed depending on the airbrush shape and size
- Ability to further complement the airbrush hanging performance by specialized notches and shape of the hanging components
- To increase holding ability by utilizing gravity by swiveling up or down on the hanging components to allow the airbrush to hold securely on the bracket with its weight and balance in the correct position
- Has the ability to hang tape, air hoses and other supplies along with the other supplies and materials Although the description above contains many specificities, these should not be construed as limiting the scope of the invention but as merely providing illustrations of some of the presently preferred embodiments of this invention. For example, this work station could have more than three airbrush hangers attached, it could be made larger or smaller to accommodate a different amount of materials. Other variations can also apply.

Thus the scope of the invention should be determined by the appended claims and their legal equivalents, rather than by the examples given.

I claim a portable device to hold a plurality of airbrushes and related airbrushing supplies comprising:

1. A portable device to hold a plurality of airbrushes and related airbrushing supplies, comprising:

a) a horizontally extending main body platform having a front side, a rear side, and two lateral sides, with vertical walls on each of said sides thereby forming a box;

b) said rear side vertical wall extending upwardly from said rear side such that said rear side wall being taller than said vertical walls on said lateral sides and said front side;

c) a horizontal flange extending forwardly from a top of said rear side vertical wall and said flange having a half-circular shaped upwardly facing support at a distal end of said horizontal flange to form a combination handle grip and a storage area for pencils, pens and similar objects;

d) bracket holes in center locations of said vertical walls of said sides and said front side vertical wall to attach individual airbrush hanger bracket assemblies thereto;

e) a plurality of holes located in four corners of said rear side vertical wall to attach mounting magnets therein for attachment to a vertical metal surface;

f) apertures located at a lower portion of said front side vertical wall with each aperture receiving a tape hanging shaft therein;

and the device further comprising a plurality of individual adjustable airbrush hanger bracket assemblies attached to said bracket holes in said vertical walls of said main body platform, each bracket assembly comprising:

a) an angled bracket body having a horizontal section and a downwardly extending vertical section, with an elongated slot extending along the length of the horizontal section and being located in a center region thereof;

b) a hole in a center of the vertical section of said angled bracket body receiving a fastener therethrough attaching said bracket assembly to one of said bracket holes in said body platform;

c) a pair of movable slides attached to said horizontal section of said angled bracket body by fasteners extending through said elongated slot which allow said slides to slide left or right in the slot for selective airbrush size adjustment, and the fastener is tightened after the selective adjustment is made;

d) a vertical flange disposed at a rear of each of said movable slides that conforms to the contour of said vertical section of said angled bracket body to allow level and even sliding of said slides along said horizontal section;

e) a half circular shaped bend at a distal front end of each of said movable slides which allows horizontal placement of an airbrush therein; and f) half circular shaped notches cut out at a bottom most section of each of said half circular shaped bends sized to receive a portion of an airbrush trigger or air inlet section that holds an airbrush in place when placed within said half circular shaped notches;

wherein each of said individual adjustable airbrush hanger bracket assemblies can pivot about the fastener which extends though the hole in the center of the vertical section of the respective assembly and a respective bracket hole in said body platform, to thereby adjust the horizontal angle at which the assembly is disposed relative to said body platform.

* * * * *